United States Patent [19]

Hopkins

[11] 4,172,306

[45] Oct. 30, 1979

[54] UTENSIL FOR OPENING CRAB LEGS AND THE LIKE

[76] Inventor: Charles H. Hopkins, 371 Park St., Fulton, N.Y. 13069

[21] Appl. No.: 897,733

[22] Filed: Apr. 19, 1978

[51] Int. Cl.[2] ..... A22C 29/02

[52] U.S. Cl. ..... 17/73; 17/75

[58] Field of Search ..... 17/66, 69, 71, 72, 73, 17/75

[56] References Cited

U.S. PATENT DOCUMENTS

| | | | |
|---|---|---|---|
| 1,843,223 | 2/1932 | Hasseler | 17/69 X |
| 2,822,845 | 2/1958 | Medlin | 17/69 X |
| 3,333,295 | 8/1967 | Spets | 17/66 |
| 3,609,800 | 10/1971 | Rollband | 17/73 |

*Primary Examiner*—Willie G. Abercrombie

*Attorney, Agent, or Firm*—Charles S. McGuire

[57] ABSTRACT

A table utensil comprising handle and a rigid blade portion for use in breaking and opening objects such as the shells surrounding the meat of crab legs. The blade includes an open slot extending along its central axis from its terminal end for a distance of an inch or two. The slot preferably terminates at an opening in the blade portion of greater diameter than the width of the slot.

7 Claims, 3 Drawing Figures

UTENSIL FOR OPENING CRAB LEGS AND THE LIKE

BACKGROUND OF THE INVENTION

The present invention relates to table utensils and, more particularly, to a utensil for breaking and opening a hollow, open-ended shell such as that of a crab leg.

Sections of Alaskan King crab legs or other such shellfish are often served in the shell, which must be broken along essentially its entire length in order to remove the edible portion. The shell cannot be conveniently cut with an ordinary table knife and attempts to break the shell by prying with a fork tine often results in bending or breaking the fork. Thus, with the table utensils commonly available, opening a section of crab leg can be a difficult and exasperating experience.

The present invention has as a principal object the provision of a table utensil which facilitates the breaking and opening along a longitudinal line of an open-ended section of crab leg, or similar object.

Another object is to provide a hand-held implement which is simple and durable in use, as well as economical in manufacture, for use as a table utensil in breaking open a section of crab leg.

Other objects will in part be obvious and will in part appear hereinafter.

SUMMARY OF THE INVENTION

In accordance with the foregoing objects, the invention comprises a utensil having a handle of conventional construction, fixedly attached by rivets or the like to the shank of a blade portion which extends outwardly from the handle to a blunt terminal end. A slot of uniform width extends along the central axis of the blade from the terminal end for a distance on the order of 1½ or 2 inches. The slot communicates with a circular opening in the blade having a diameter larger than the width of the slot.

Thus, the terminal end of the blade is divided by the slot into two sections. In use, one of the sections is inserted into an open end of a crab leg as far as the slot and opening in the blade will allow. As the handle is then lifted upwardly, the end of the section outside the shell serves as a lever and the shell is broken as the blade section inside the shell is lifted. The operation is repeated, with the first blade section inserted farther into the crab leg as the latter is broken from the prying action of the blade, until the shell is opened along its entire length.

DETAILED DESCRIPTION

Figure 1:
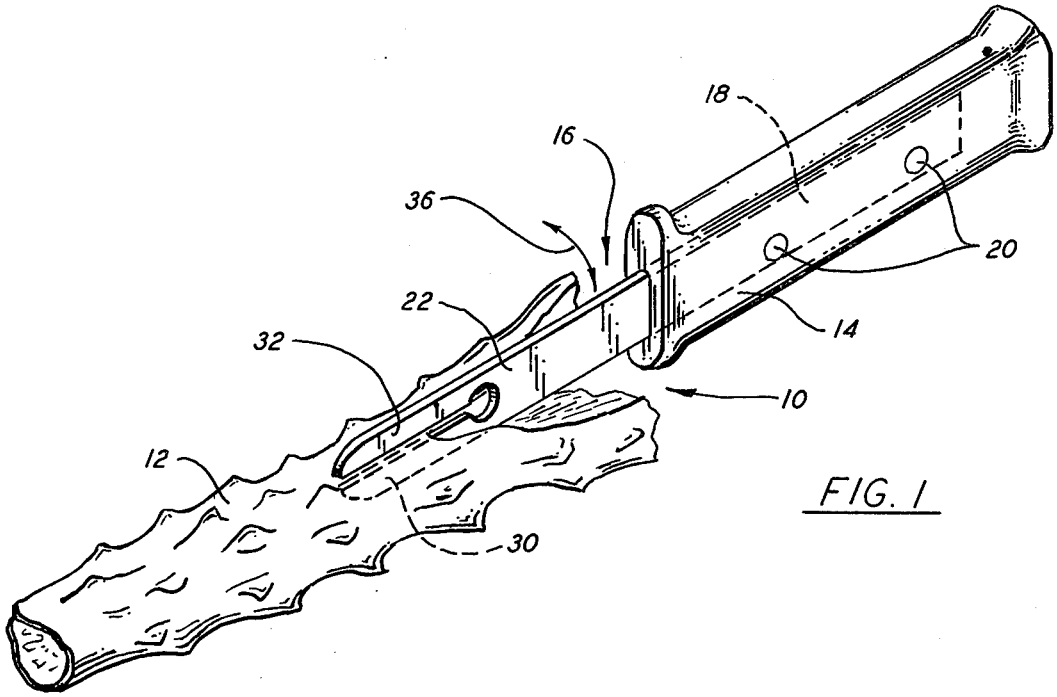
FIG. 1 is a perspective view of the utensil of the invention shown during the operation of opening a crab leg.

Referring now to the drawing, the utensil of the invention, denoted generally by reference numeral 10, is shown in FIG. 1 in its intended manner of employment, breaking and opening shell 12 of a section of crab leg to gain access to the edible portion within the shell. Utensil 10 includes handle 14, of any desired configuration convenient for grasping in the hand of a user, and planar blade 16 having a shank 18 extending into handle 14 and fixedly secured thereto in conventional fashion by rivets

20. Rigid portion 22 of blade 16 extends from shank 18 outwardly from handle 14 to terminal end 24. Rigid portion 22 is bifurcated by slot 26 which extends from terminal end 24 along the longitudinal axis of blade 16. Slot 26 communicates with circular opening 28 which has a diameter larger than the width of slot 26.

Thus, blade 16 is divided from its terminal end 24 along a portion of its length of arbitrary dimension, but preferably in the range of one to two inches, into two sections 30 and 32. The width of slot 26 is somewhat greater than the thickness of the usual crab leg shells, e.g., ⅛", and may be of constant width along its entire length. The width and thickness of sections 30 and 32, together with the material from which blade 16 is fabricated, is such that each of the sections is rigid and capable of withstanding a reasonable degree of applied force without bending or breaking.

The manner of employment of utensil 10 is readily apparent from the showing of FIG. 1. Blade section 30 is inserted into one of the open ends of shell 12 until the edge of the shell engages the side of opening 28. The user grasping handle 14 then lifts upwardly, essentially rotating utensil 10 about terminal end 24. The end of section 32 bears against the outer surface of the shell and serves as a lever as section 30 is lifted to break the shell. The edge formed at 34, where slot 26 communicates with opening 28 assists in making the initial break in the shell and facilitates raising the edge of section 30 bordering slot 26 through the shell. Handle 14 is then moved downwardly, again rotating utensil 10 about terminal end 24 and moved forwardly to advance section 30 further into shell 12. The operation is repeated, with utensil 10 being reciprocally rotated about end 24, as indicated by arrows 36, while it is advanced along the shell. Upon completion of the operation, shell 12 is fully opened along its length, providing ready access to the edible portion within the shell.

Figure 2:
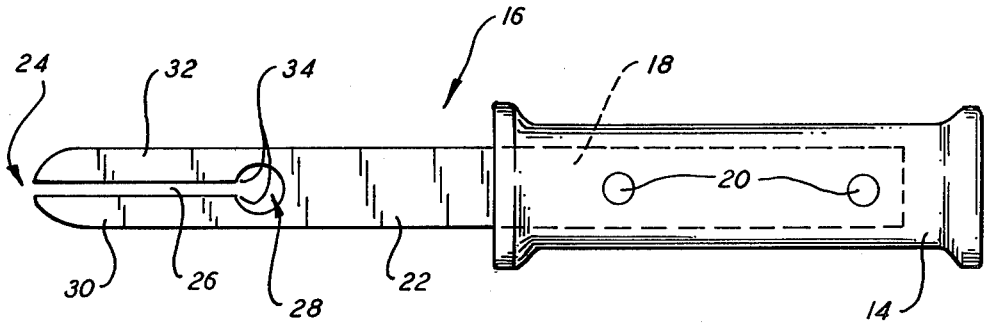
FIG. 2 is a front elevational view of the utensil.
Figure 3:
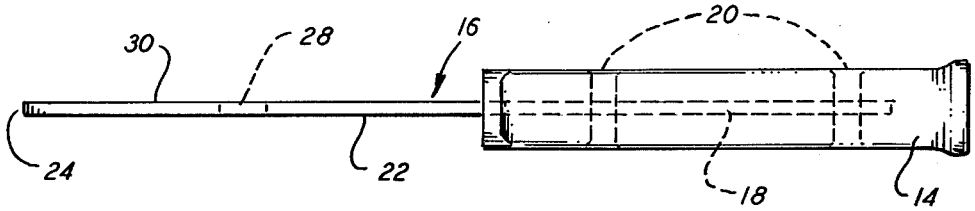
FIG. 3 is a side elevational view thereof.

Utensil 10 is preferably symmetrical about its longitudinal axis in front elevation (FIG. 2). Thus, either of sections 30 and 32 may be inserted into the shell and the utensil may be employed in either the right or the left hand with equal facility. Since the utensil breaks the shell with a prying action, there is no necessity for sharpening any edges of blade 16, thereby keeping fabrication costs at a minimum while still providing a very durable and attractive implement.

What is claimed is:

1. A utensil adapted to break and open elongated sections of open-ended crab leg shells and similar objects, said utensil comprising:

(a) a manually engageable handle;

(b) a planar blade fixedly secured to said handle and extending therefrom to a terminal end;

(c) an open-ended slot extending linearly from said terminal end along the longitudinal axes of said blade for a portion of its length forwardly of said handle, whereby said portion of said blade is symmetrically divided by said slot into two identical sections; and (d) the material and dimensions of said blade being such that all portions thereof, including said two sections, are rigid and substantially inflexible.

2. The invention according to claim 1 wherein said slot is of substantially constant width along its entire length.

3. The invention according to claim 1 wherein said blade includes a shank portion extending into said handle and secured thereto.

4. The invention according to claim 1 wherein said blade includes an opening with which said slot communicates at the end thereof opposite said blade terminal end, said opening being wider than said slot at the point of communication therewith.

5. The invention according to claim 4 wherein said opening is circular, having a diameter greater than the width of said slot, the latter being constant along its entire length.

6. The invention according to claim 5 wherein said blade is symmetrical about its longitudinal axis.

7. The invention according to claim 6 wherein the combined length of said slot and said opening is not substantially greater than one-half the length of said blade forwardly of said handle.

* * * * *